US010213819B2

(12) United States Patent
Ito et al.

(10) Patent No.: US 10,213,819 B2
(45) Date of Patent: Feb. 26, 2019

(54) PRESS FORMING METHOD

(71) Applicant: SANGO CO., LTD., Miyoshi-shi, Aichi (JP)

(72) Inventors: Yoshiki Ito, Miyoshi (JP); Jiro Kagitani, Miyoshi (JP); Osamu Nishihara, Miyoshi (JP)

(73) Assignee: SANGO CO., LTD., Miyoshi-Shi, Aichi-Ken (JP)

( * ) Notice: Subject to any disclaimer, the term of this patent is extended or adjusted under 35 U.S.C. 154(b) by 84 days.

(21) Appl. No.: 15/504,900

(22) PCT Filed: Feb. 19, 2016

(86) PCT No.: PCT/JP2016/054833
§ 371 (c)(1),
(2) Date: Feb. 17, 2017

(87) PCT Pub. No.: WO2016/136612
PCT Pub. Date: Sep. 1, 2016

(65) Prior Publication Data

US 2017/0266706 A1 Sep. 21, 2017

(30) Foreign Application Priority Data

Feb. 27, 2015 (JP) ..... 2015-038194

(51) Int. Cl.
*B21D 5/01* (2006.01)
*B21D 22/20* (2006.01)
(Continued)

(52) U.S. Cl.
CPC ..... *B21D 5/01* (2013.01); *B21D 22/20* (2013.01); *B21D 22/26* (2013.01); *B21D 53/88* (2013.01)

(58) Field of Classification Search
CPC ..... B21D 5/01; B21D 22/26; B21D 22/20; B21D 53/88
(Continued)

(56) References Cited

U.S. PATENT DOCUMENTS

2001/0052255 A1 12/2001 Arai
2010/0201158 A1 8/2010 Miyashita
(Continued)

FOREIGN PATENT DOCUMENTS

JP 6-154897 A 6/1994
JP 2002-1445 A 1/2002
(Continued)

OTHER PUBLICATIONS

International Search Report (PCT/ISA/210) dated Apr. 19, 2016, by the Japanese Patent Office as the International Searching Authority for International Application No. PCT/JP2016/054833.
(Continued)

*Primary Examiner* — David B Jones
(74) *Attorney, Agent, or Firm* — Buchanan Ingersoll & Rooney PC

(57) ABSTRACT

A press forming method for producing a saddle type final product comprises a first process of producing an intermediate product having a processing adjustment section, by cold press working against an ultrahigh tensile strength steel plate, to deform the side wall portions and flange portions at both sides in the predetermined area, with the cross section of the top plate portion being maintained in a predetermined shape, and a second process of pressing at least the processing adjustment section, by cold press working against the intermediate product, with the cross section of the top plate portion being maintained in the predetermined shape. In at least one of the first process and second process, a processing target of the at least one process is bent in the direction
(Continued)

opposite to the opening of the hat-shaped cross section, to produce the saddle type final product.

4 Claims, 6 Drawing Sheets

(51) Int. Cl.
*B21D 22/26* (2006.01)
*B21D 53/88* (2006.01)

(58) Field of Classification Search
USPC ..... 72/352
See application file for complete search history.

(56) References Cited

U.S. PATENT DOCUMENTS

| | | | | |
|---|---|---|---|---|
| 2013/0104618 | A1 | 5/2013 | Daimaru | |
| 2015/0224563 | A1* | 8/2015 | Aso | B21D 22/26 428/595 |
| 2016/0375477 | A1* | 12/2016 | Tanaka | B21D 5/01 72/356 |

FOREIGN PATENT DOCUMENTS

| | | | |
|---|---|---|---|
| JP | 2008-12570 | A | 1/2008 |
| JP | 2009-73420 | A | 4/2009 |
| JP | 2010-69490 | A | 4/2010 |
| JP | 2010-284674 | A | 12/2010 |
| JP | 4709659 | B2 | 6/2011 |
| JP | 4757820 | B2 | 8/2011 |
| JP | 5234262 | B2 | 7/2013 |
| WO | 2011148880 | A1 | 12/2011 |
| WO | WO 2014/042067 | A1 | 3/2014 |

OTHER PUBLICATIONS

Written Opinion (PCT/ISA/237) dated Apr. 19, 2016, by the Japanese Patent Office as the International Searching Authority for International Application No. PCT/JP2016/054833.

Office Action (Notification of Reasons for Refusal) dated Dec. 6, 2017, by the Japanese Patent Office in corresponding Japanese Patent Application No. 2017-502321, and an English Translation of the Office Action. (6 pages).

* cited by examiner

FIG. 3
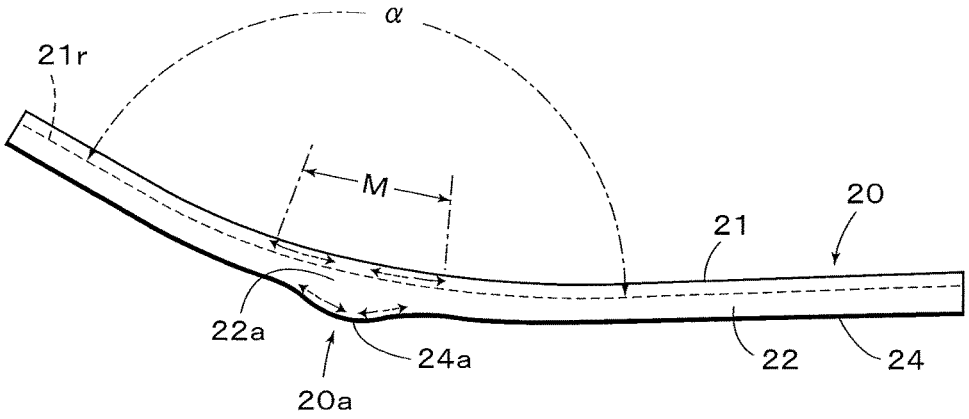
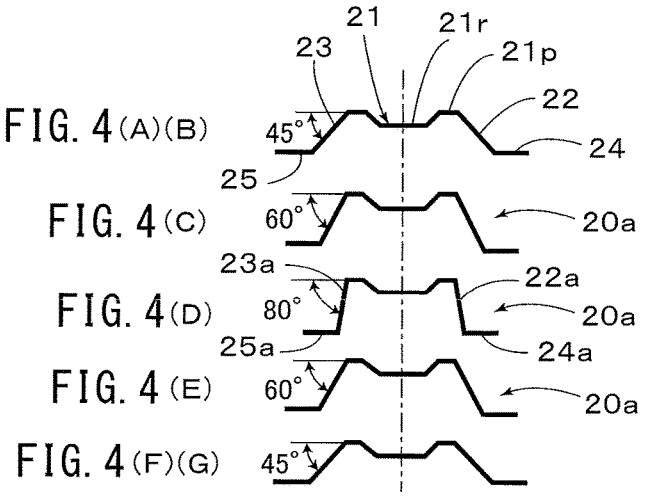
FIG. 5
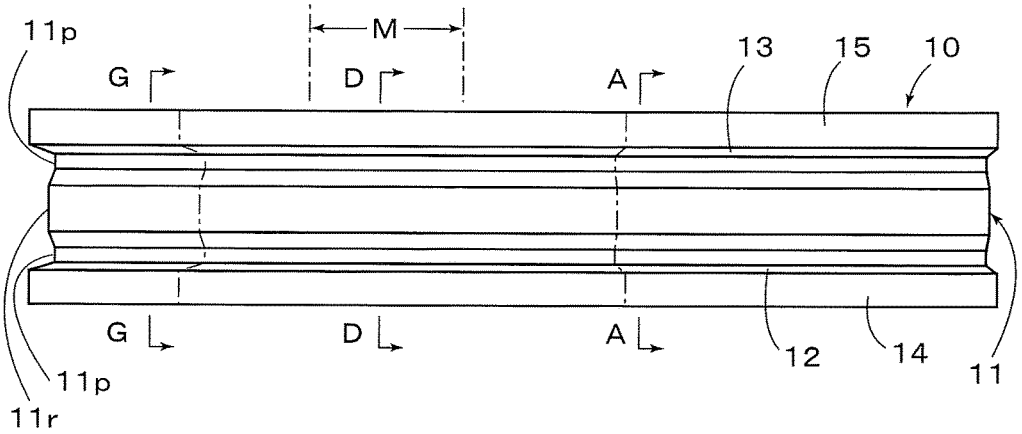

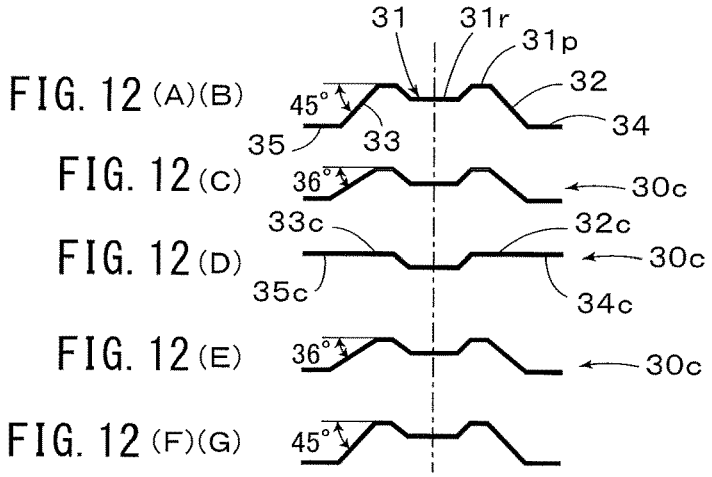
FIG. 13
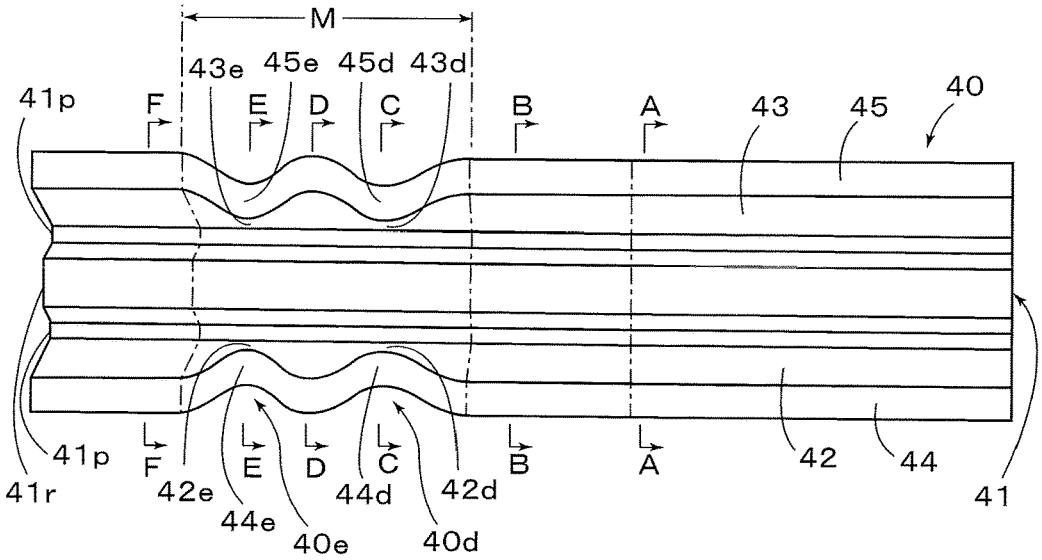
FIG. 14
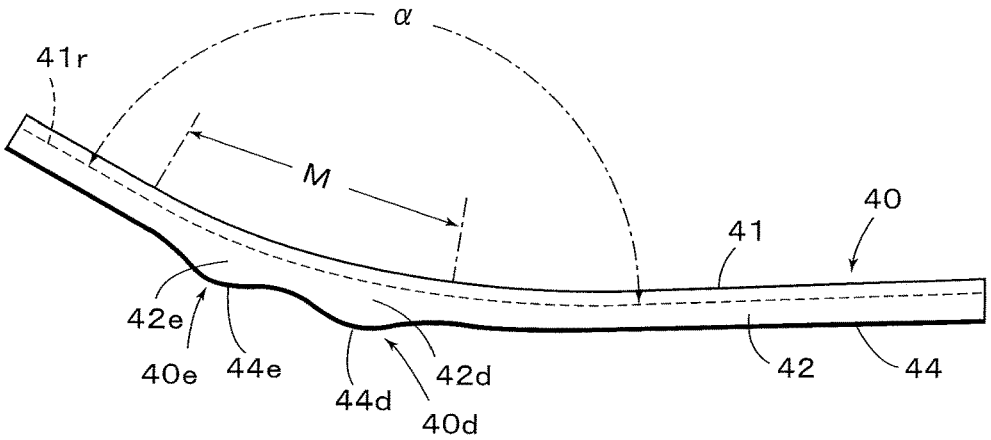

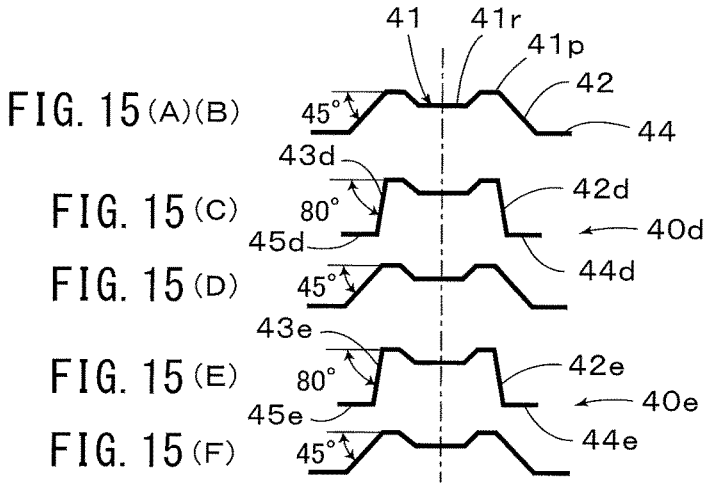
FIG. 16
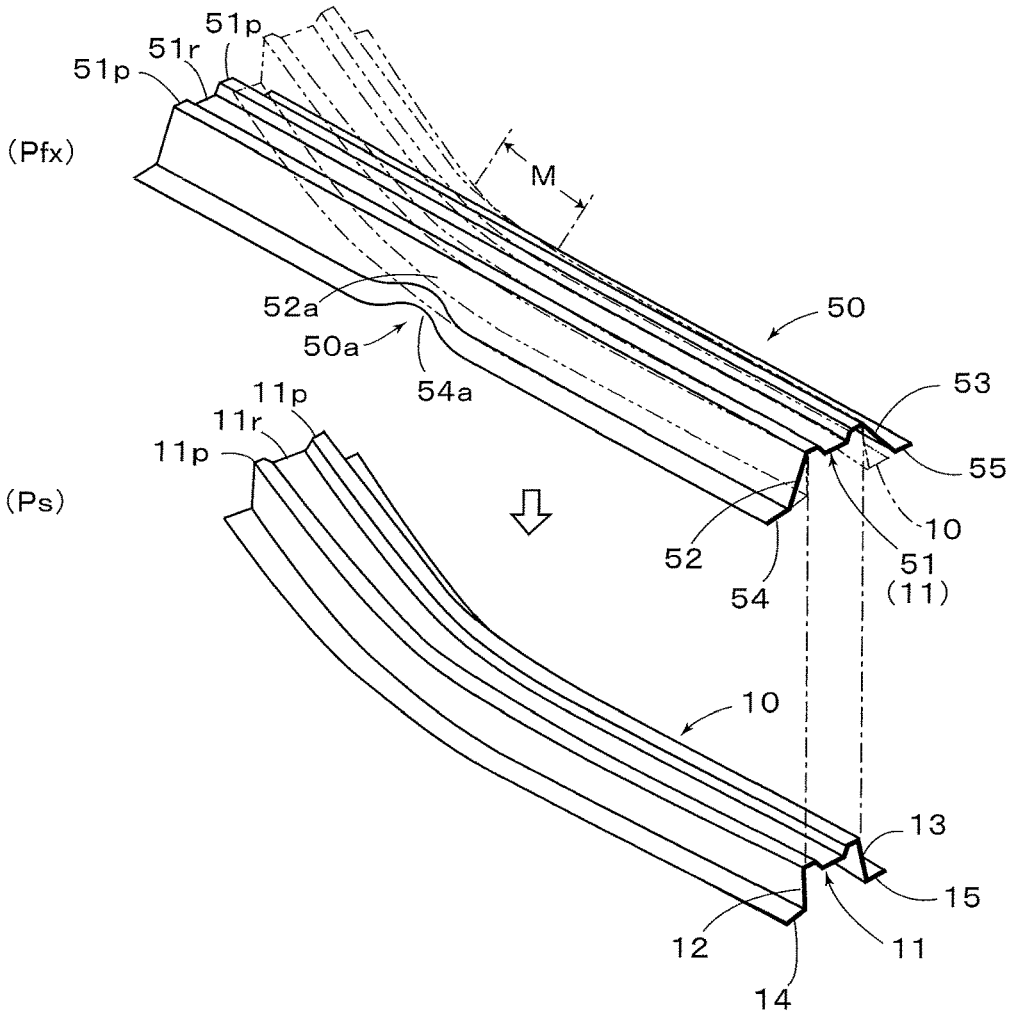

PRESS FORMING METHOD

TECHNICAL FIELD

The present invention relates to a press forming method, particularly a press forming method for producing a saddle type final product by press working against an ultrahigh tensile steel plate.

BACKGROUND ART

In order to comply with tighter environmental regulations, it is required to lighten an automotive body structure further. And, in order to reduce an amount of the present material to be used, by increasing its strength, it is likely to use a high tensile steel plate for a structural member. As for the high tensile steel plate in general, the high tensile steel plate having tensile strength of 440 Mpa class or 590 Mpa class, which is easily formed by a cold press working, has been employed by now. Then, the high tensile steel plate having tensile strength of 780 Mpa class or 980 Mpa class has been used. Recently, such an ultrahigh tensile steel plate with tensile strength exceeding 1 Gpa as being called "ultrahigh-ten. steel plate" begins to be used. Furthermore, the ultrahigh tensile steel plate with tensile strength of 1.2 Gpa class or 1.5 Gpa class is being considered to be used. The higher in tensile strength the ultrahigh tensile steel plate becomes, the poorer its workability (ductility) becomes. As stress is generated when the press working was applied to the ultrahigh tensile steel plate, and released when the plate is removed from the die, such a phenomenon that the plate is elastically deformed, i.e., a so-called spring back is caused, whereby it will be difficult to ensure a desired dimensional accuracy. In addition, increase in forming load, and reduction of the die's life resulted therefrom will be concerned.

As a method for dealing with those, a hot press working (hot stamping) is generally used to form the ultrahigh tensile steel plate. This is, such a forming method that a quenching steel plate is heated up to about 900° C. in a high temperature furnace to be softened, and the press working is applied to it, and thereafter it is held at its bottom dead point to be contacted with the die, so that the quenching is strengthened by cooling effect (contact cooling). However, the hot press working is limited for such a specific material that is to be cooled uniformly even at a slow cooling speed. In addition, as it is heated at about 900° C. with its outer surface being oxidized, such a post-processing as removing oxidized scale is required. Furthermore, such specific problems are to be solved for the hot press working that not only a large exclusive heating furnace and a conveyance facility are required, but also energy consumption thereby is extremely increased. Therefore, although it is craved that the cold press working is applied to form the ultrahigh tensile steel plate, such new problems are caused that a shape of final product to be formed is limited, and so on.

For example, it is not easy to produce such final products having a U-shaped cross section or a hat-shaped cross section that are frequently used for vehicle body structural members such as vehicle members or a pillar, by means of the cold press working. As an example of the final product having the U-shaped cross section or hat-shaped cross section, it is described in Patent document 1 as listed below that in order to obtain a metallic member (press final product) having an accurate U-shaped or hat-shaped cross section, and a normal shape (designed shape) curved in a direction within a specific surface, without adjusting a die shape, and with a predetermined part shape being maintained, such a method is proposed to form a metallic member having a U-shaped or hat-shaped cross section, and having a shape curved in a longitudinal surface, that with respect to one curved part out of a plurality of curved parts formed on the metallic member, an intermediate product having a smaller radius of curvature than a shape of a final product is formed in a first forming step, and in a second forming step, it is formed into a larger radius of curvature than the radius of curvature in the first forming step, and remaining parts are formed, without changing the radius of curvature of the die in the first and second forming steps, to make the entire formed product to be formed with the product shape or substantial product shape (described in paragraphs (0004) and (0005) of Patent document 1).

Furthermore, with respect to a saddle type product to be bent in a direction opposite to an opening of a U-shaped cross section, it is described in Patent document 2 as listed below that in order to provide a drawing method without creating a crinkling on a bent portion even of a saddle type product with its gutter-shaped cross section being reversely curved, such a method is proposed to form a saddle type product curved in a reverse direction to an opening of its gutter-shaped cross section, by applying a plurality of drawing steps to a flat plate material, that in an intermediate drawing step, at least one end portion of the saddle type curved part is formed with a chipping surface of a planer surface or a curved surface, to form an intermediate shaped product having a difference of elevation between the opposite end portions of saddle type curved part, and in a finishing drawing step, it is drawn to a desired product profile, with the chipping surface being expanded to be disappeared from the intermediate shaped product (described in paragraphs (0009) and (0010) of Patent document 2).

Also, it is described in Patent document 3 as listed below that in order to provide a press die capable of obtaining a product of a high quality without crinkle, crack or the like by a single step drawing, even for a saddle type product having a large reversely curved part, and capable of expecting reduction of working time and manufacturing cost, such a method is described that by lowering an upper die, a work placed on a lower pad extruded from a lower die is clamped by an upper pad extruded from the upper die to be fixed, and by further lowering the upper die, inserting a tip end of a bead forming material into a recessed portion of a bead forming upper material, and by means of a cam driver, a cam slide, and therefore, the tip end of the bead forming material is retracted from the recessed portion to form beads, and in the next lowering step, by means of the lower punch and upper die, it is drawn into the U-shaped cross section, and in accordance with next lowering of the upper die, the restriction against the upper pad by a gas spring is relieved, so that the upper pad becomes capable of being received in the upper die, and with the beads being extended by the lower punch and upper die, the work is drawn into the final shape (described in paragraphs (0006) and (0008) of Patent document 3).

On the other hand, it is described in Patent document 4 as listed below that in order to obtain a metallic member having an accurate U-shaped or hat-shaped cross section, and a normal shape curved in a height direction, without adjusting a die shape, and with a predetermined part shape being maintained, such a multi-stage press forming method is proposed to form a metallic member having a U-shaped or hat-shaped cross section, and a shape curved in a height direction with a ceiling part surface between side walls being placed at an upper surface, that an intermediate product with an emboss protruded in the height direction in the ceiling part surface between side walls of the metallic member, so that a length of its longitudinal direction will be longer than a length of a line of a final product in its longitudinal direction, is formed in a first forming step, and in a second forming step, it is formed into a product shape with the emboss being pressed so as to be removed (described in paragraphs (0004) and (0006) of Patent document 4). Furthermore, an embodiment for forming a product with a hat-shaped cross section by use of a steel plate of 980 Mpa class with its thickness of 1.6 mm is disclosed in its paragraph (0019).

PRIOR ART DOCUMENT

Patent Document

Patent document 1: Japanese Patent No. 4757820
Patent document 2: Japanese Patent No. 5234262
Patent document 3: Japanese Patent Laid-open Publication No. 1994-154897
Patent document 4: Japanese Patent No. 4709659

SUMMARY OF THE INVENTION

Problems to be Solved by the Invention

However, the Patent document 1 relates to a method for forming a metallic member having a shape curved on a surface in a longitudinal direction, and its target is a product with a shape curved in a lateral direction on the surface in the longitudinal direction. Therefore, it is not the one that is formed to be bent in the direction opposite to the opening of U-shaped or hat-shaped cross section, nor aimed to form such product. Furthermore, as it is described in the paragraph (0016) of Patent document 1 that a displacement of a ridge line is created between the curved portions of the shapes of intermediate product and final product, so that a deformation has been created on its top plate portion, with its example being shown in FIG. 2.

In contrast, the products as disclosed in the Patent documents 2 and 3 are formed to be bent in the direction opposite to the opening of U-shaped cross section. However, those products are merely the products formed with U-shaped cross section, and the intermediate products to be formed into those are required to be formed with beads or the like in advance. Therefore, when the press working is applied to the intermediate product with the hat-shaped cross section, a new problem will be necessarily arisen, so that even if the methods as described in Patent documents 2 and 3 are applied to form the ultrahigh tensile steel plate, any desirable products cannot be produced.

On the other hand, although the method for forming the product with the hat-shaped cross section by the ultrahigh tensile steel plate is disclosed in the Patent document 4, after forming the metallic member having the U-shaped or hat-shaped cross section, and the shape curved in the height direction with the ceiling part surface between side walls being placed at an upper surface, and forming the intermediate product with the emboss protruded in the height direction in the ceiling part surface between side walls of the metallic member is formed in the first forming step, so that the length of its longitudinal line will be longer than the length of the longitudinal line of the final product, and in the second forming step, it is formed into the product shape with the emboss being pressed so as to be removed (described in its paragraph (0006)), it has been a premise that the shapes of ceiling parts are to be varied between the intermediate product and the final product. Therefore, the target of the method as described in Patent document 4 is limited to the product having the U-shaped or hat-shaped cross section, and having the shape curved in the height direction with the ceiling part surface between side walls being placed at the upper surface, so that the method is never applicable to the saddle type product formed to be bent in the direction opposite to the opening of the hat-shaped cross section.

As described above, it is not easy to form a saddle type final product by press working against the steel plate to produce an elongated member of the hat-shaped cross section having an elongated top plate portion, and side wall portions and flange portions at both sides of the top plate portion, and bend a predetermined area of the elongated member in the direction opposite to the opening of the hat-shaped cross section, and moreover it is not easy to form the saddle type final product by means of the cold press working against the ultrahigh tensile steel plate, which is formed to be bent in the direction opposite to the opening of the hat-shaped cross section, with the cross sectional shape of the top plate portion being maintained. With the aforementioned ultrahigh tensile steel plate getting popular, however, an appropriate press forming method to form it has been craved.

According to the present invention, therefore, it is an object to provide a press forming method for producing a saddle type final product by means of a cold press working against an ultrahigh tensile steel plate.

Means for Solving the Problems

To solve the above-described problems, the present invention is proposed to provide a press forming method for producing a saddle type final product by press working against a steel plate to produce an elongated member of a hat-shaped cross section having an elongated top plate portion, and side wall portions and flange portions at both sides of the top plate portion, and bend a predetermined area of the elongated member in a direction opposite to an opening of the hat-shaped cross section, the press forming method comprising a first process of producing an intermediate product having a processing adjustment section, by cold press working against an ultrahigh tensile strength steel plate to deform the side wall portions and flange portions at the both sides in the predetermined area of the elongated member, with the cross section of the top plate portion being maintained in a predetermined shape, and a second process of pressing at least the processing adjustment section, by cold press working against the intermediate product, with the cross section of the top plate portion being maintained in the predetermined shape, wherein, in at least one of the first process and second process, a processing target of the at least one process is bent in the direction opposite to the opening of the hat-shaped cross section, to produce the saddle type final product.

According to the present invention, therefore, the press forming method may be configured to have a first process of producing an intermediate product having a processing adjustment section, by cold press working against an ultrahigh tensile strength steel plate to deform the side wall portions and flange portions at the both sides in the predetermined area of the elongated member, with the cross section of the top plate portion being maintained in a predetermined shape, and the intermediate product being bent in the direction opposite to the opening of the hat-shaped cross section, and a second process of pressing at least the processing adjustment section, by cold press working against the intermediate product, with the cross section of the top plate portion being maintained in the predetermined shape, and the intermediate product being bent in the direction opposite to the opening of the hat-shaped cross section, to produce the saddle type final product. Also, the press forming method may be configured to have a first process of producing an intermediate product having a processing adjustment section, by cold press working against an ultrahigh tensile strength steel plate to deform the side wall portions and flange portions at the both sides in the predetermined area of the elongated member, with the cross section of the top plate portion being maintained in a predetermined shape, and a second process of pressing at least the processing adjustment section, by cold press working against the intermediate product, with the cross section of the top plate portion being maintained in the predetermined shape, and the intermediate product being bent in the direction opposite to the opening of the hat-shaped cross section, to produce the saddle type final product. Furthermore, the press forming method may be configured to have a first process of producing an intermediate product having a processing adjustment section, by cold press working against an ultrahigh tensile strength steel plate to deform the side wall portions and flange portions at the both sides in the predetermined area of the elongated member, with the cross section of the top plate portion being maintained in a predetermined shape, and the intermediate product being bent in the direction opposite to the opening of the hat-shaped cross section, and a second process of pressing at least the processing adjustment section, by cold press working against the intermediate product, with the cross section of the top plate portion being maintained in the predetermined shape, to produce the saddle type final product.

With respect to the press forming method as described above, in the first process, inclined angles of the side wall portions at the both sides relative to the top plate portion may be varied in the predetermined area, to deform the side wall portions portion and flange portions at the both sides in the predetermined area. In this respect, the inclined angles of the side wall portions relative to the top plate portion in the predetermined area of the intermediate product can be set to be 0 degree to 90 degree.

Furthermore, in the above-described press forming method, a longitudinal dimension of the intermediate product including an extended amount in the longitudinal direction in the predetermined area, which amount is determined by the deformed amount of the side wall portions and flange portions, may be set to be 110% of the longitudinal dimension of the final product in the same area as the predetermined area.

Also, in the above-described press forming method, the intermediate product may be the one that possesses a plurality of processing adjustment sections in the longitudinal direction of the predetermined area.

Effects of the Invention

As the present invention is configured as described above, the following effects can be achieved. That is, according to the press forming method of the present invention, it comprises a first process of producing an intermediate product having a processing adjustment section, by cold press working against an ultrahigh tensile strength steel plate to deform the side wall portions and flange portions at the both sides in the predetermined area, with the cross section of the top plate portion being maintained in a predetermined shape, and a second process of pressing at least the processing adjustment section, by cold press working against the intermediate product, with the cross section of the top plate portion being maintained in the predetermined shape, wherein, in at least one of the first process and second process, a processing target of the at least one process is bent in the direction opposite to the opening of the hat-shaped cross section, to produce the saddle type final product, and it is so configured that the processing adjustment section is formed on the intermediate product in the first process, and the processing adjustment section is pressed in the second process to substantially disappear, the deformed amount caused when bending can be absorbed by the shape of the intermediate product itself. Therefore, without forming beads or the like separately, by means of the cold press working against the ultrahigh tensile steel plate, maintaining the cross-sectional shape of the top plate portion, by bending it in the direction opposite to the opening of the hat-shaped cross section, the saddle type final product can be produced.

In the above-described press forming method, if inclined angles of the side wall portions at the both sides relative to the top plate portion are varied in the predetermined area, in the first process, to deform the side wall portions portion and flange portions at the both sides in the predetermined area, the saddle type final product can be easily produced, without forming beads or the like separately. That is, if it is so configured that by varying the inclined angles of the side wall portions relative to the top plate portion in the predetermined area of the intermediate product, the side wall portions and flange portions are deformed to form the processing adjustment section, and in the second process, by pressing the processing adjustment section to produce the final product, the 3-dimensional deformed amount, which is created when bending, can be absorbed by the shape of the intermediate product itself, so that beads or the like are not required to be formed separately. Particularly, by setting the inclined angles to be 0 degree to 90 degree, various types of press forming can be performed in accordance with a property of working target, or characteristic of material.

Or, in the above-described press forming method, if the longitudinal dimension of the intermediate product including the extended amount in the longitudinal direction in the predetermined area is set to be 110% of the longitudinal dimension of the final product in the same area as the predetermined area, the deformed amount created when bending, can be absorbed appropriately by the shape of the intermediate product itself, so that the saddle type final product can be produced easily and surely.

Furthermore, in the above-described press forming method, if the intermediate product is the one that possesses a plurality of processing adjustment sections in the longitudinal direction of the predetermined area, the deformed amount created when bending, can be absorbed easily and appropriately by the shape of the intermediate product itself, so that various types of press forming can be performed in accordance with a property of working target, or characteristic of material.

BRIEF DESCRIPTION OF THE DRAWINGS

FIG. 3 is a side view of an intermediate product produced by an embodiment of a press forming method according to the present invention.

FIGS. 4(A)-4(G) is a sectional view sectioned along A-A line to G-G line in FIG. 2.

FIG. 5 is a plan view of a final product produced by an embodiment of a press forming method according to the present invention.

FIGS. 12(A)-12(G) is a sectional view sectioned along A-A line to G-G line in FIG. 10.

FIG. 13 is a plan view of an intermediate product produced by a further embodiment of a press forming method according to the present invention.

FIG. 14 is a side view of an intermediate product produced by a further embodiment of a press forming method according to the present invention.

FIGS. 15(A)-15(F) is a sectional view sectioned along A-A line to F-F line in FIG. 13.

FIG. 16 is a perspective view showing an intermediate product and a final product produced by a yet further embodiment of a press forming method according to the present invention.

EMBODIMENTS FOR CARRYING OUT THE INVENTION

Figure 1:
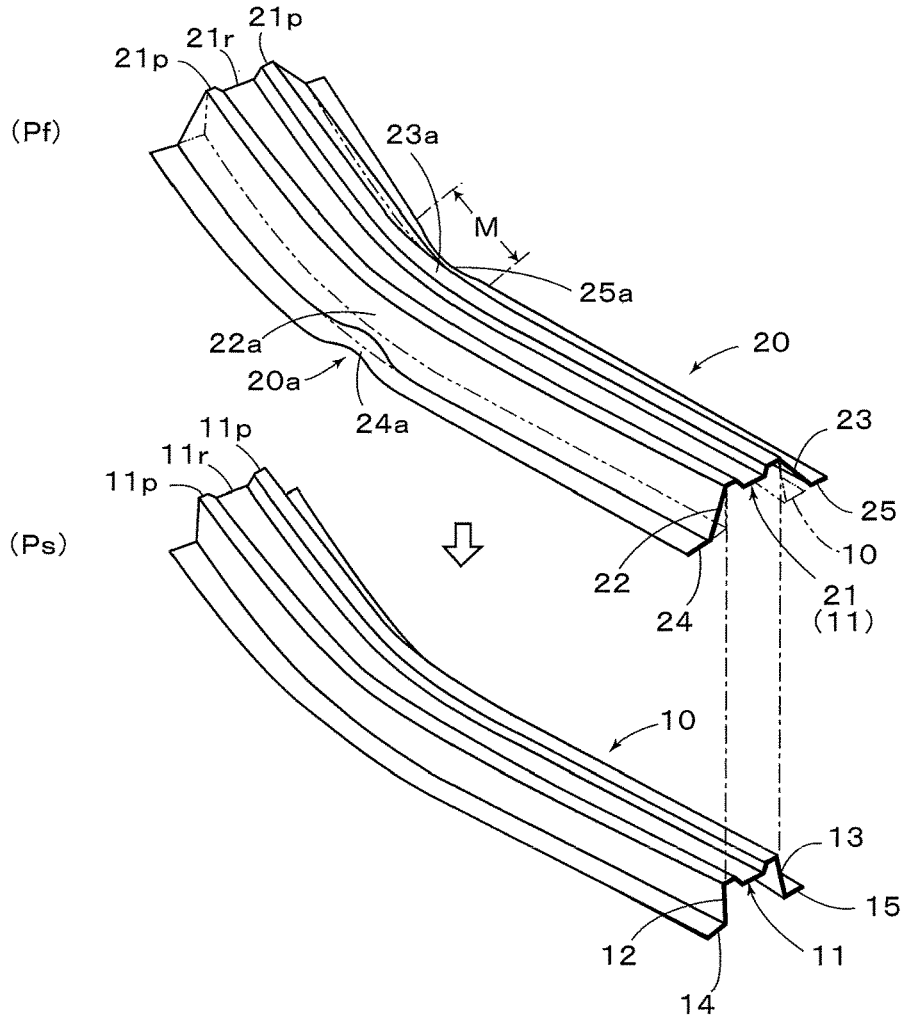
FIG. 1 is a perspective view showing an intermediate product and a final product produced by an embodiment of a press forming method according to the present invention.

Hereinafter, will be explained desirable embodiments of the present invention referring to drawings. FIG. 1 shows an intermediate product 20 produced after a first process (Pf) in an embodiment of a press forming method according to the present invention, and a final product 10 produced after a second process (Ps). In addition to these processes, boring, trimming and so on are arbitrarily performed, drawings of which are omitted in FIG. 1. At the outset, will be explained about a saddle type final product 10 as shown in a lower part of FIG. 1, wherein an elongated member of a hat-shaped cross section having an elongated top plate portion 11, side wall portions 12 and 13, and flange portions 14 and 15 at its both sides, is bent in a direction opposite to the opening of the hat-shaped cross section (upward in FIG. 1) to be formed into the saddle type, and it is served as a vehicle body structural member, for example.

According to the present embodiment, the top plate portion 11 is formed with a recessed portion 11*r* in the lateral center, and protruded portions 11*p*, 11*p* at its both sides, by which a step portion is formed to extend in the longitudinal direction. Instead of the step, a protruded portion 11*p* may be formed in the lateral center, and other shapes, or a plate shape (plane) may be employed, as far as a predetermined section modulus can be ensured.

In order to produce the final product 10 as described above, according to the present embodiment, a cold-rolled steel sheet "SPC1180" with sheet thickness of 1.6 mm is used as the ultrahigh tensile steel plate, and the cold press working is performed by a press apparatus (shown in FIGS. 8 and 9) as described later. At the outset, in the first process (Pf), by means of the cold press working against the ultra-high tensile steel plate as described above, maintaining a predetermined shape (approximately the same shape as the top plate portion 11 of the final product 10 shown in the lower part of FIG. 1) as indicated by two-dotted chain lines in the upper part of FIG. 1, i.e., maintaining approximately the same shape as the top plate portion 11 without deforming a top plate portion 21, by deforming side wall portions 22 and 23 and flange portions 24 and 25 at its both sides in a predetermined area (M), to form a processing adjustment section 20*a*, and bending it in the direction opposite to the opening of the hat-shaped cross section, an intermediate product 20 is produced.

Figure 2:
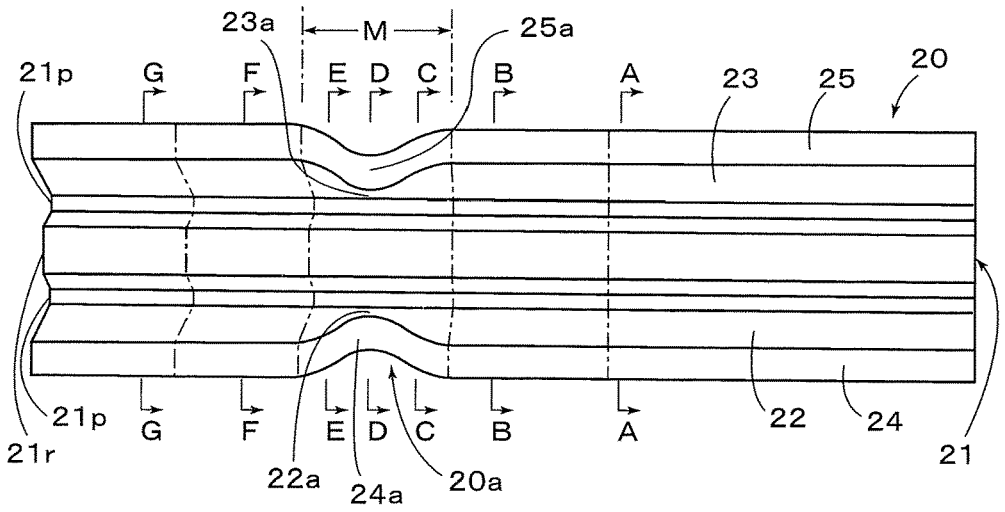
FIG. 2 is a plan view of an intermediate product produced by an embodiment of a press forming method according to the present invention.

According to the present embodiment, the intermediate product 20 is formed as shown in FIGS. 2-4. That is, by varying the inclined angles of the side wall portions 22 and 23 relative to the top plate portion 21 in the predetermined area (M) of the intermediate product 20, the side wall portions 22 and 23 and flange portions 24 and 25 with the same cross sections as those cross sections as shown in (A), (B), (F) and (G) in FIG. 4 are deformed into the side wall portions 22*a* and 23*a* and flange portions 24*a* and 25*a* as shown in (C)-(E) in FIG. 4 in the predetermined area (M), and side shapes of the side wall portion 22 and flange portion 24 are deformed into side shapes of the side wall portions 22*a* and flange portion 24*a* as shown in FIG. 3 (the side wall portion 23 and flange portion 25 are deformed in the same manner). The processing adjustment section 20*a* is configured by the side wall portion 22*a* and 23*a*, and flange portion 24*a* and 25*a*, so that the intermediate product 20 with a bent angle $\alpha$ (e.g., 139 degree) as shown in FIG. 3 is produced.

Then, in the second process (Ps), by means of the cold press working against the intermediate product 20 as described above, maintaining the cross section of the top plate portion 21 to be the predetermined shape, by pressing the processing adjustment section 20*a* (so that the processing adjustment section 20*a* will substantially disappear), and bending it in the direction opposite to the opening of the hat-shaped cross section, to be formed into the saddle type, the final product 10 as described above is produced. Although the top plate portion 11 and the top plate portion 21 with different bent angles being provided are not of the same shape in a strict sense, in such a sense that the top plate portion 21 is maintained to be approximately the same shape as the target top plate portion 11, without deforming the top plate portion 21 (except for varying the bent angle of the top plate portion 21), the first process (Pf) is performed with the cross section of the plate portion 21 being maintained in the predetermined shape, and the second process (Ps) is performed.

Figure 6:
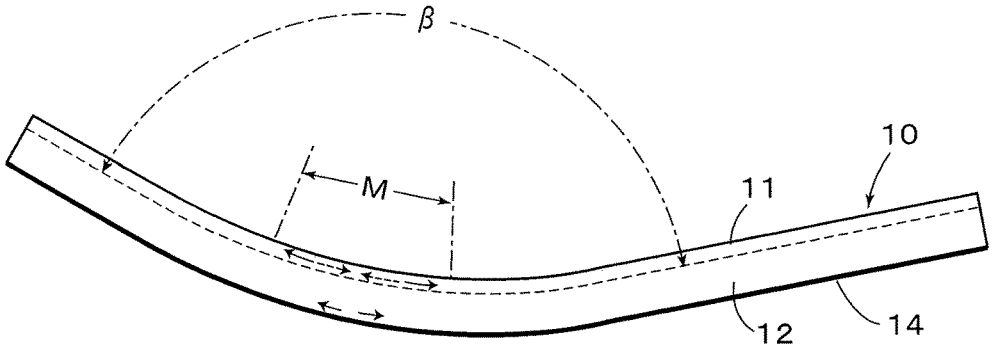
FIG. 6 is a side view of a final product produced by an embodiment of a press forming method according to the present invention.
Figure 7:
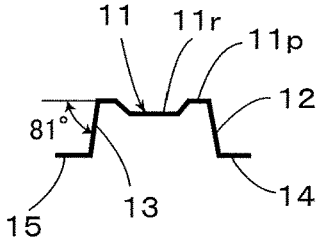
FIG. 7 is a sectional view sectioned along A-A line, D-D line and G-G line in FIG. 5.

Accordingly, the final product 10 will be formed into the shape as shown in FIGS. 5-7. That is, the cross sections of the side wall portions 22 and 23 and flange portions 24 and 25 as shown in (A), (B), (F) and (G) in FIG. 4, and the cross sections of the side wall portions 22*a* and 23*a* and flange portions 24*a* and 25*a* as shown in (C)-(E), are deformed into the cross sections of the side wall portions 12 and 13 and flange portions 14 and 15 as shown in FIG. 7, and also the cross sections of the side wall portions 22, 22*a* and flange portions 24, 24*a* as shown in FIG. 3 are deformed into the cross sections of the side wall portion 12 and flange portion 14 as shown in FIG. 6 (the cross sections of the side wall portions 23, 23*a* and flange portions 25, 25*a* are deformed in the same manner), so that the saddle type final product 10 is formed with the side wall portions 12 and 13 and flange portions 14 and 15 having the same cross section along the whole length, and a bent angle β (e.g., 149 degree) as shown in FIG. 6. Although the final product 10 of the present embodiment is formed in the same cross section along the whole length, such a saddle type final product with its cross section being gradually varied in the longitudinal direction can be formed in the same manner.

According to the above-described intermediate product 20, as shown in FIG. 3, compressive stresses as indicated by dashed line arrows are applied to the inside of the bent portion in the predetermined area (M), so that tensile stresses as indicated by solid line arrows are remained after the first process (Pf). On the other hand, with respect to the processing adjustment section 20*a* at the outside of the bent portion, as shown in FIGS. 2-4, the side wall portions 22 and 23 and flange portions 24 and 25 are deformed 3-dimensionally to become the side wall portions 22*a* and 23*a* and flange portions 24*a* and 25*a*. That is, boundary lines (inside ridge lines) between the top plate portion 21 and the side wall portions 22*a* and 23*a* before processing, and boundary lines (outside ridge lines) between the side wall portions 22*a* and 23*a* and the flange portions 24*a* and 25*a* before processing in the predetermined area (M), are bent after processing, so that they become longer than the boundary lines (inside ridge lines) between the top plate portion 21 and the side wall portions 22 and 23, and boundary lines (outside ridge lines) between the side wall portions 22 and 23 and the flange portions 24 and 25 in the predetermined area (M). Also, in the present embodiment, as shown in FIG. 3, contour lines at the outside of the bent portions of the side wall portions 22*a* and 23*a* and the flange portions 24*a* and 25*a* after processing become longer than those portions before processing. That is, appeared in FIGS. 2 and 3 are lateral components and longitudinal components of 3-dimensionally deformed amounts created at the side wall portions 22 and 23 and flange portions 24 and 25 in the predetermined area (M). As a result, the tensile stresses are applied to the processing adjustment section 20*a* as indicated by the dashed line arrows in the lower part of FIG. 3, so that the compressive stresses as indicated by the solid line arrows are remained after the first process (Pf).

And, according to the final product 10, as shown in FIG. 6, the compressive stresses as indicated by the dashed line arrows are applied to the inside of the bent portion in the predetermined area (M) in the same manner as in FIG. 3, so that tensile stresses as indicated by solid line arrows in the upper part of FIG. 6 are remained after the second process (Ps). However, at the outside of the bent portions, the compressive stresses are applied, when the processing adjustment section 20*a* is pressed (to substantially disappear), so that the tensile stresses as indicated by the solid line arrows in FIG. 6 are remained after the second process (Ps). As a result, at the inside and outside of the bent portion of the final product 10, only tensile stresses as indicated by the solid line arrows are remained, so that the tensile stresses are balanced as a whole, the spring back or torsion can be prevented from being created. While a figure is omitted herein, in the case where the bending is applied to an intermediate product (not shown) without the above-described processing adjustment section 20*a* being formed in the same manner as the prior forming method, the tensile stress is remained at the inside of the bent portion, and the compressive stress is remained at the outside of the bent portion, so that the spring back may be created to be returned to the state before bending, or the torsion might be created.

Figure 8:
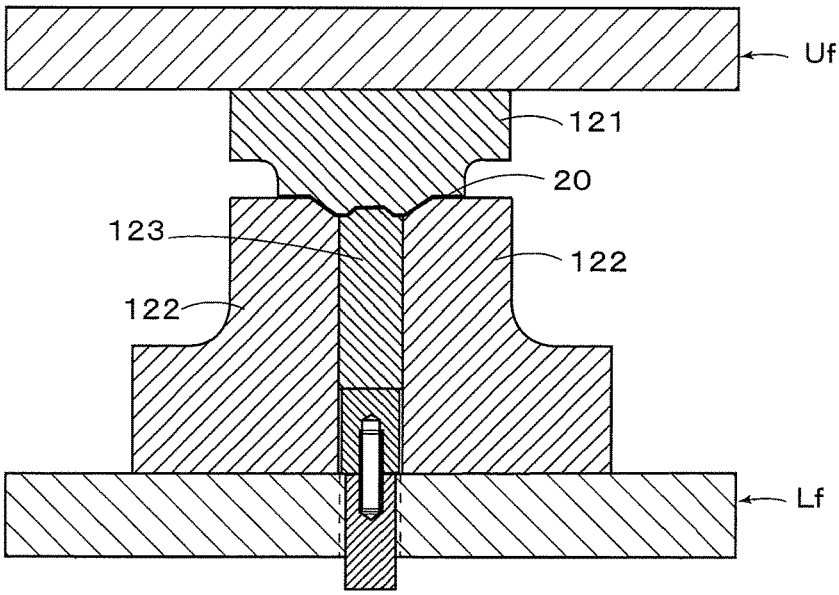
FIG. 8 is a sectional view showing a part of a press apparatus for use in a first process according to an embodiment of the present invention.

Hereinafter will be described about apparatuses for use in the first process (Pf) and second process (Ps) as described above. FIG. 8 shows an apparatus for use in the first process (Pf), wherein it is so configured that a work of ultrahigh tensile steel plate is placed on a lower die (Lf), and an upper die (Uf) is driven downward to form the intermediate product 20 by so-called stamping, whereby 500 tons of working force, for example, is applied to the work. The upper die (Uf) is installed with a die 121 having a pressing surface with a predetermined shape (contour of the intermediate product 20), and the lower die (Lf) is installed with a punch 122 and a pad 123 for providing a pressing surface with a similar predetermined shape. With those dies, the side wall portions 22 and 23 and flange portions 24 and 25 are formed to be of the cross sections as shown in (A)-(G) in FIG. 4.

Figure 9:
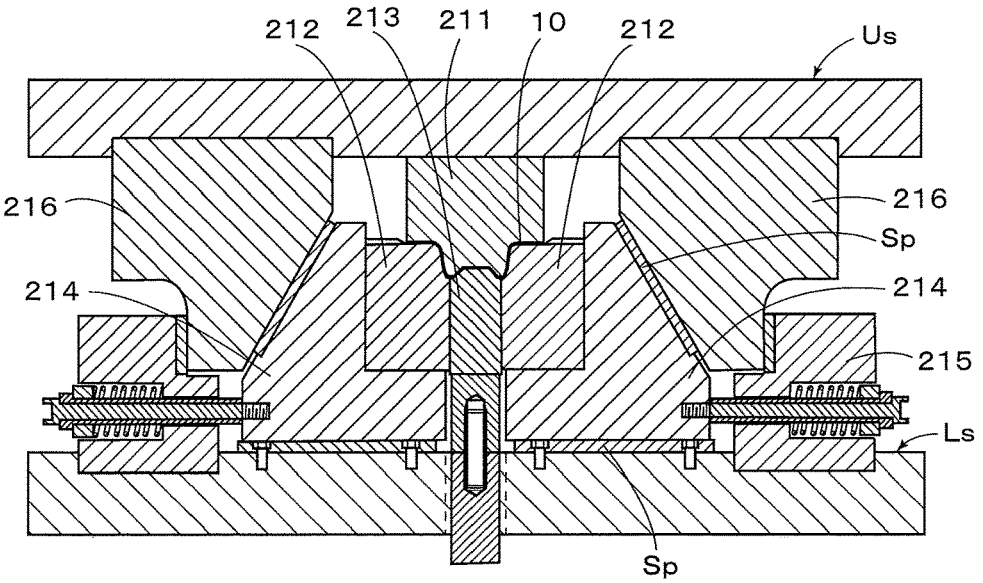
FIG. 9 is a sectional view showing a part of a press apparatus for use in a second process according to an embodiment of the present invention.

FIG. 9 shows an apparatus for use in the second process (Ps), wherein it is so configured that the intermediate product 20 is placed on a lower die (Ls), and an upper die (Us) is driven downward to produce the final product 10 by so-called cam-bending, whereby 400 tons of working force, for example, is applied to the intermediate product 20. The upper die (Us) is installed with a die 211 having a pressing surface with a predetermined shape (contour of the final product 10), and the lower die (Ls) is provided with a punch 212 and a pad 213 for providing a pressing surface with a similar predetermined shape. The punch 212 is movably supported by a slider 214 through a slide plate Sp, so as to move close to or remote from the pad 213. Furthermore, the upper die (Us) is installed with a driver 216, so as to be supported in such a manner that an inclined surface (cam surface) of the driver 216 and an inclined surface (cam surface) of the slider 214 are pressed to each other through the slide plate Sp. The lower die (Ls) is provided with a guide member 215, which guides the driver 216 in a vertical direction, and which returns the punch 212 (functions as a return spring). Accordingly, in such a state that the intermediate product 20 is placed on the lower die (Ls), when the upper die (Us) is driven downward, with the driver 216 being guided by the guide member 215 to move downward, the slider 214 is driven toward the pad 213, thereby to produce the final product 10 by the so-called cam-bending (bending by cam).

According to the above-described embodiment, the inclined angles of the side wall portions 22*a* and 23*a* relative to the top plate portion 21 in the predetermined area (M) of the intermediate product 20 is set to be 80 degree as shown in (D) of FIG. 4, which may be set to be a certain angle within a range of 0 degree to 90 degree. As described before, the longitudinal extension in the predetermined area (M) is determined by the 3-dimensional deformed amount created on the side wall portions 22 and 23 and flange portions 24 and 25 of the intermediate product 20. The longitudinal dimension of the intermediate product 20 including the longitudinal extension is set, for example, to be 110% of the longitudinal dimension of the final product 10 in the same area as the predetermined area (M), in conformity with which the inclined angles of the side wall portions 22*a* and 23*a* relative to the top plate portion 21 are set. With respect to the above-described 110%, it is provided as an appropriate value according to the present embodiment. However, it is not limited to that rate, but it may be provided in accordance with a property of the ultrahigh tensile steel plate, or shapes of the final product 10 and intermediate product 20, which are resulted from a simulation or various analyzations.

Figure 10:
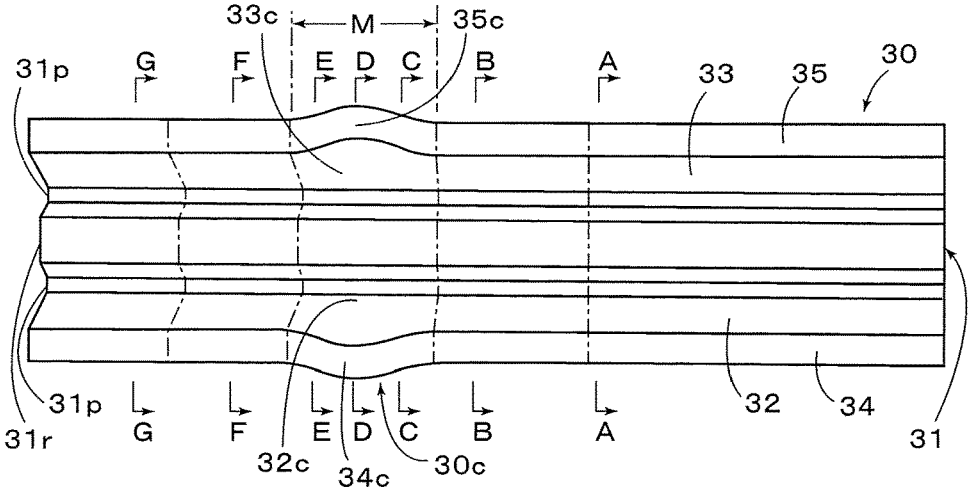
FIG. 10 is a plan view of an intermediate product produced by another embodiment of a press forming method according to the present invention.
Figure 11:
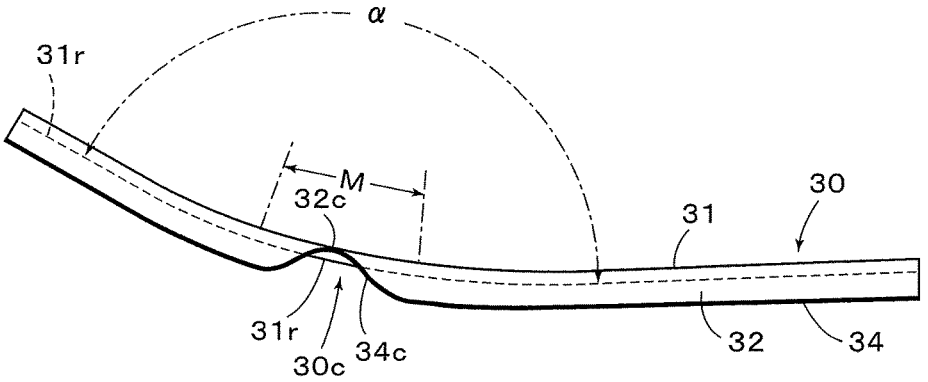
FIG. 11 is a side view of an intermediate product produced by another embodiment of a press forming method according to the present invention.

Furthermore, in the case where the inclined angles of the side wall portions 22*a* and 23*a* relative to the top plate portion 21 in the predetermined area (M) of the intermediate product 20 is set to be 0 degree, an intermediate product 30 as shown in FIGS. 10-12 is produced, as will be described hereinafter as another embodiment. That is, according to the intermediate product 30 as shown in FIGS. 10-12, the side wall portions 32 and 33 and flange portions 34 and 35 with the same cross sections as those cross sections shown in (A), (B), (F) and (G) in FIG. 12 are deformed into the side wall portions 32*c* and 33*c* and flange portions 34*c* and 35*c* shown in (C)-(E) in FIG. 12 in the predetermined area (M), and side shapes of the side wall portion 32 and flange portion 34 are deformed into side shapes of the side wall portions 32*c* and flange portion 34*c* as shown in FIG. 11 (the side wall portion 33 and flange portion 35 are deformed in the same manner). Then, a processing adjustment section 30*c* is configured by the side wall portion 32*c* and 33*c* and flange portion 34*c* and 35*c*, so that the intermediate product 30 with the bent angle α (e.g., 139 degree) as shown in FIG. 11 is produced.

In FIGS. 10-12, except for the above-described 30*c* and so on, corresponding parts to the parts indicated by 20's as shown in FIGS. 2-4 are indicated by 30's, which parts are substantially the same as those parts, and therefore, explanations of which are omitted herein. Also, like in the aforementioned embodiment, the deformation of the intermediate product 30 to the final product 10 is the 3-dimensional deformation, so that the top plate portion 11 and the top plate portion 31 with different bent angles being provided are not of the same shape in a strict sense. However, in such a sense that the top plate portion 31 is maintained to be approximately the same shape as the target top plate portion 11, without deforming the top plate portion 31 (except for varying the bent angle of the top plate portion 31), the first process can be performed, with the cross section of the plate portion 31 being maintained in the predetermined shape.

According to the above-described intermediate products 20 and 30, the processing adjustment sections 20*a* and 30*a* are provided at one section, respectively. However, a plurality of processing adjustment sections may be provided in the longitudinal direction within the predetermined area (M), an embodiment of which is shown in FIGS. 13-15. That is, an intermediate product 40 as shown in FIGS. 13-15 is formed such that the side wall portions 42, 43 and flange portions 44, 45 with the same cross sections as those cross sections as shown in (A), (B) and (F) in FIG. 15 are deformed into the side wall portions 42*d*, 42*e*, 43*d* and 43*e* and flange portions 44*d*, 44*e*, 45*d* and 45*e* as shown in (C)-(E) in FIG. 15 in the predetermined area (M), and side shapes of the side wall portion 42 and flange portion 44 are deformed into side shapes of the side wall portions 42*d*, 42*e* and flange portions 44*d*, 44*e* as shown in FIG. 14 (the side wall portion 43 and flange portion 45 are deformed in the same manner). Therefore, two processing adjustment sections 40*d* and 40*e* are configured by the side wall portions 42*d*, 42*e*, 43*d* and 43*e* and flange portions 44*d*, 44*e*, 45*d* and 45*e*, so that the intermediate product 40 with the bent angle α (e.g., 139 degree) as shown in FIG. 14 is produced.

In FIGS. 13-15, except for the above-described 40*d*, 40*e* and so on, corresponding parts to the parts indicated by 20's as shown in FIGS. 2-4 are indicated by 40's, which parts are substantially the same as those parts, and therefore, explanations of which are omitted herein.

In each of the above-described embodiments, the intermediate products 20, 30 and 40 are formed to be bent. Instead, as shown in FIG. 16, for example, the bending may not be performed in a first process (Pfx), but it may be performed only in the second process (Ps). That is, in the first process (Pfx) as shown in FIG. 16, by means of the cold press working against the ultrahigh tensile steel plate, maintaining a predetermined shape of a top plate portion 51 without deforming it, by deforming side wall portions 52 (numeral to the opposite wall portion is omitted) and flange portions 54 (numeral to the opposite flange portion is omitted) at its both sides in the predetermined area (M) to form a processing adjustment section 50*a*, an intermediate product 50 is produced.

Then, in the second process (Ps), by means of the cold press working against the intermediate product 50 as described above, by pressing the processing adjustment section 50*a* (so that the processing adjustment section 50*a* will substantially disappear), and bending it in the direction opposite to the opening of the hat-shaped cross section, to be formed into the saddle type, the final product 10 as described above is produced. In the second process (Ps), with the top plate portion 51 being maintained to be a predetermined shape (except for variations before and after the bending), it is formed to be bent in the direction opposite to the opening of the hat-shaped cross section.

Contrary to the embodiment as shown in FIG. 16, the bending may not be performed in the second process, but it may be performed only in the first process. For example, in the first process (Pf) as shown in FIG. 1, maintaining the cross section of the top plate portion 21 to be a predetermined shape, by deforming the side wall portions 22*a*, 23*a* and flange portions 24*a*, 25*a* at its both sides in the predetermined area (M), to form the processing adjustment section 20*a*, and bending it in the direction opposite to the opening of the hat-shaped cross section, the intermediate product 20 may be produced, and in the second process (Ps), by means of the cold press working against the intermediate product 20, maintaining the cross section of the top plate portion 21 to be the predetermined shape, by pressing the processing adjustment section 20, without bending it, the final product 10 as shown in FIG. 1 may be produced.

As described above, in any embodiments as described above, by varying the inclined angles of the side wall portions 22 and 23 relative to the top plate portion 21 in the predetermined area (M) of the intermediate product 20, the side wall portions 22 and 23 and flange portions 24 and 25 are deformed to form the processing adjustment section 20*a* and so on, and in the second process (Ps), by pressing the processing adjustment section 20*a* (so that the processing adjustment section 20*a* and so on will substantially disappear), the final product 10 is formed. Therefore, the 3-dimensional deformed amount, which is created when bending, can be absorbed by the shape of the intermediate product 20 itself, so that beads or the like are not required to be formed separately. Although the processing adjustment section 20*a* and so on do not disappear completely, and a pressed mark such as a discolored portion for example will be remained, any trouble will not be caused in the use of the product. In any embodiments, such a product that is formed with flanges or the like at both of opposite ends of the final product 10 can be produced by the processes including the first process (Pf, Pfx) and second process (Ps).

DESCRIPTION OF CHARACTERS

10 final product
20, 30, 40, 50 intermediate product
11, 21, 31, 41, 51 top plate portion
12, 22, 32, 42, 52 side wall portion

13, 23, 33, 43, 53 side wall portion
14, 24, 34, 44, 54 flange portion
15, 25, 35, 45, 55 flange portion
20*a*, 30*c*, 40*d*, 40*e*, 50*a* processing adjustment section
Pf first process
Ps second process
Uf, Us upper die
Lf, Ls lower die
121, 211 die
122, 212 punch
123, 213 pad
214 slider
216 driver

The invention claimed is:

1. A press forming method for producing a final product having a saddle shape from an ultrahigh tensile strength steel plate to form an elongated member of a hat-shaped cross section having an elongated top plate portion, and side wall portions and flange portions at both sides of the top plate portion, with a bend in a predetermined area of the hat-shaped cross section configuring an elongated part of the elongated member in a direction opposite to an opening of the hat-shaped cross section, the press forming method comprising:

a first process of producing an intermediate product having a processing adjustment section, by cold press working against the ultrahigh tensile strength steel plate, in which inclined angles of the side wall portions produced in the intermediate product are varied in the predetermined area at the both sides relative to the top plate portion such that the side wall portions and flange portions at the both sides in the predetermined area of the elongated member are deformed, while the hat-shaped cross section of the top plate portion is maintained in a predetermined shape, and a second process of pressing at least the processing adjustment section, by cold press working against the intermediate product, with the hat-shaped cross section of the top plate portion being maintained in the predetermined shape, wherein, in at least one of the first process and second process, the predetermined area is bent in the direction opposite to the opening of the hat-shaped cross section, to produce the saddle shape.

2. The press forming method of claim 1, wherein the inclined angles of the side wall portions relative to the top plate portion in the predetermined area of the intermediate product are set to be 0 degree to 90 degree.

3. The press forming method of claim 1, wherein a longitudinal dimension of the intermediate product including an extended amount in the longitudinal direction in the predetermined area, which amount is determined by the deformed amount of the side wall portions and flange portions, is set to be 110% of the longitudinal dimension of the final product in the same area as the predetermined area.

4. The press forming method of claim 1, wherein the intermediate product possesses a plurality of processing adjustment sections in the longitudinal direction of the predetermined area.

* * * * *